US005725679A

United States Patent [19]

Kitazawa et al.

[11] Patent Number: 5,725,679

[45] Date of Patent: Mar. 10, 1998

[54] CLEANING PROCESS AND DETERGENT USED THEREFOR

[75] Inventors: Kozo Kitazawa; Atsushi Tamura, both of Wakayama, Japan

[73] Assignee: Kao Corporation, Tokyo, Japan

[21] Appl. No.: 536,526

[22] Filed: Sep. 29, 1995

[30] Foreign Application Priority Data

Oct. 13, 1994 [JP] Japan ..... 6-275713

[51] Int. Cl.[6] ..... B08B 9/04

[52] U.S. Cl. ..... 134/10; 134/29; 134/40; 134/42; 510/417; 510/421; 510/422; 510/423

[58] Field of Search ..... 134/10, 29, 40, 134/42; 540/417, 421, 422, 423

[56] References Cited

U.S. PATENT DOCUMENTS

| | | | |
|---|---|---|---|
| 5,096,501 | 3/1992 | Dishart et al. | 134/10 |
| 5,350,457 | 9/1994 | Kitazawa et al. | 134/10 |
| 5,522,940 | 6/1996 | Kitazawa et al. | 134/10 |

FOREIGN PATENT DOCUMENTS

| | | |
|---|---|---|
| 2146633 | 3/1973 | France . |
| 57-101676 | 6/1982 | Japan . |
| 62-41080 | 9/1987 | Japan . |
| 03062895 | 3/1991 | Japan . |
| 362895 | 3/1991 | Japan . |
| 03094082 | 4/1991 | Japan . |
| 394082 | 4/1991 | Japan . |
| 03162496 | 7/1991 | Japan . |
| 3-162496 | 7/1991 | Japan . |

OTHER PUBLICATIONS

English Abstract of Japanese Patent No. 2034683.

English Abstract of Japanese Patent No. 3–62895.

English Abstract of Japanese Patent No. 3–94082.

English Abstract of Japanese Patent No. 3–162496.

*Primary Examiner*—Jill Warden

*Assistant Examiner*—Sharidan Carrillo

*Attorney, Agent, or Firm*—Birch, Stewart, Kolasch & Birch, LLP

[57] ABSTRACT

The process for cleaning a cleaning object includes the steps of forming a water phase and an oil phase in a vessel of a cleaning apparatus, the water phase having a lower content of organic substances in a detergent than the oil phase, and cleaning the cleaning object in the water phase.

8 Claims, 1 Drawing Sheet

CLEANING PROCESS AND DETERGENT USED THEREFOR

BACKGROUND OF THE INVENTION

1. Field of the Invention

The present invention relates to a process for cleaning rigid surfaces of glass, ceramics, metals, plastics, etc., and a detergent used therefor. Specifically, the present invention relates to a process for cleaning machine parts, electrical parts, electronic parts, various precision parts, machine tools used for assembling or processing these parts, or the like, which are stained with fats and oils, machine oils, quenching oils, greases, cutting oils or other working oils, waxes, liquid crystals, fluxes, abrasion dusts, cutting dusts, or the like (there parts and tools being collectively hereinafter referred to as "machine and precision parts"), and a detergent used therefor. More specifically, it relates to a process for cleaning comprising forming a water phase and an oil phase, the water phase having a lower content of the organic substances in the detergent than the oil phase, and cleaning a cleaning object using the water phase containing smaller amounts of the organic substances.

2. Background of the Related Art

Conventionally, chlorine-based solvents such as 1,1,1-trichloroethane and tetrachloroethylene, and chlorofluorocarbon solvents such as trichlorotrifluoroethane have been used for cleaning rigid surfaces of glass, ceramics, metals, plastics, etc., including rigid surfaces of machine parts, electrical parts, electronic parts, various precision parts, machine tools used for assembling or processing these parts, which are stained with fats and oils, machine oils, quenching oils, greases, cutting oils or other working oils, waxes, liquid crystals, fluxes, abrasion dusts, cutting dusts, or the like, because these solvents have a high cleaning performance and are easy to handle.

The use of detergents containing chlorofluorocarbon- or chlorine-based solvents and production thereof have been totally banned or legally regulated, as they have proven to be potentially hazardous to the global environment due to ozone layer depletion, etc. caused by atmospheric evaporation or diffusion of the hazardous solvents contained as a main component thereof.

In order to solve the above problems, various detergents that can replace such chlorofluorocarbon- or chlorine-based detergents or cleaning techniques using the detergents have already been proposed. Typical examples thereof include the following:

1) A cleaning process using a hydrocarbon solvent, such as kerosene, toluene, xylene, or petroleum solvent, or a detergent comprising such a hydrocarbon solvent and a suitable amount of a surfactant (Japanese Patent Laid-Open No. 3-94082);

2) A cleaning process using glycols, a liquid nonionic surfactant of low viscosity, or a dense detergent liquid comprising such a substance and a small amount of water (Japanese Patent Laid-Open Nos. 3-62895 and 3-162496); and 3) A cleaning process using a detergent containing a surfactant and builder, the detergent being diluted with a large amount of water.

However, the cleaning processes exemplified by processes 1) and 2) have risks of catching fire, exploding, and polluting workplace environment due to evaporation of volatile organic components, such as hydrocarbon solvents, because organic substances form a continuous phase. Also, aqueous solutions of detergents and cleaning processes using the detergents typically exemplified by process 3) is desirable from the viewpoint of workplace environmental protection, because it is free from the risks of catching fire and pollution of workplace environment due to evaporation of organic components. Therefore, the cleaning processes exemplified by process 3) are considered presently to be typical cleaning techniques which substitute chlorofluorocarbon- or chlorine-based detergents.

The aqueous solution of the detergent has a composition comprising a surfactant used as a main component and builders having a reinforcing function or supplementing function for the surfactants. The surfactant upon cleaning has functions of adsorbing on the surfaces or interfaces of the cleaning objects, to which organic stains, such as metal working oils, liquid crystals, and waxes, and inorganic stains, such as polishing dusts, abrasion dusts or dirts, are adhered, to lower or increase tension or voltage of the surfaces or interfaces, accelerating or promoting the removal of stains from the surfaces of the cleaning objects. In addition, the surfactant also has a function of stabilizing the organic or inorganic stain substances mentioned above, which are detached from the cleaning objects and float in a cleaning liquid or a rinsing liquid, by such processes as emulsification, solubilization, or dispersion, thereby preventing the stained substances from being attached or re-contaminated to the surfaces of the cleaning objects.

The above surfactants may be roughly classified into ionic surfactants in which ionic dissociation takes place, and nonionic surfactants in which ions are not dissociated, depending upon whether or not a hydrophilic group in a molecule is dissociated into ions. The surfactants which are mainly used in detergents are anionic surfactants, which are dissociated to show anionic property, and nonionic surfactants. The anionic surfactants have strong hydrophilic properties due to ionization, they are effective in removing dirts having strong polarity, such as inorganic stains. As for the removal of organic stains having a relative small polarity, including metal working oils, liquid crystals, and waxes, the nonionic surfactants are effectively used.

Examples of the builders which are generally used include inorganic salts, such as sodium hydroxide, sodium carbonate, sodium silicates, and sodium phosphate. Although the builders alone show only a slight cleaning performance, when used together with a surfactant, the builders function to reinforce the functions owned by the surfactants (for example, decreasing interfacial tension).

From the above, the functions of the surfactants are extremely important in the cleaning process.

The entire cleaning process using an aqueous detergent generally comprises a cleaning process using an aqueous solution of a detergent, a rinsing process with water, and finally a drying process. Among the above processes, the cleaning process is a particularly important process, because stains adhered on the surfaces of the object to be cleaned are detached and removed from the surfaces in the process. The cleaning conditions, such as the detergent composition, concentrations thereof, cleaning temperature, time, and mechanical force, for the cleaning process are determined by sufficiently taking into consideration the effects on the cleaning performance, quality, and reliability required for the object to be cleaned after cleaning and influence on the materials used.

Therefore, in order to maintain the cleaning performance, quality, etc. required for the object to be cleaned after cleaning, the cleaning conditions are required to be controlled so as to make the cleaning conditions stable. Among the cleaning conditions mentioned above, the detergent concentration is particularly likely to vary during cleaning process due to the conveying of the cleaning liquids adhered to the cleaning object, supplementing water or the detergent, or the water evaporation. When the detergent concentration is lower than a given level of concentration, cleaning deficiency is likely to take place, and when the detergent concentration is higher than a given level, there arise such problems as disadvantageous effects on the parts of the objects to be cleaned or increase in cleaning costs. Therefore, in order to control the detergent concentration at a given level, a device for measuring the detergent concentration, equipments for supplying the detergent or water, and human resources for running these equipments are necessitated.

Various methods have been so far proposed for the measurements of the detergent concentration. As for the detergents mainly comprising inorganic salts, relatively inexpensive and simple measuring devices such as pH meters and those devices utilizing electric conductivity or titration method have been developed. However, such measurement devices cannot be used for the measurement of detergent concentration comprising particularly nonionic surfactants as a main component, and quantitative analyses such as EPTON method disclosed in Kaimenkasseizai Binran (Published on Jul. 5, 1960, by Sangyo Tosho Kabushiki Kaisha), p-toluidine method, phosphorus molybdic acid method, have been known. However, these quantitative analyses require a long period of time with large individual difference, so that they are not suitable for controlling detergent concentration in the cleaning workplace at all.

On the other hand, in the cleaning of parts or products requiring particular care in preventing disadvantageous effects on parts or maintaining production quality such as reliability, including mainly precision parts and electronic parts, the surfactant-based detergent with small amounts or no inorganic builders have been increasingly used. Therefore, in view of the above problems, a detergent with easy control of the detergent concentration and a cleaning process using the detergent are in demand.

SUMMARY OF THE INVENTION

An object of the present invention is to provide a cleaning process using an aqueous solution of a detergent by suitably maintaining a given detergent concentration to thereby achieve a high cleaning performance, without carrying out such complicated operations as the measurement of concentrations of detergent components, and to inhibit the operable environment from being worsened.

Another object of the present invention is to provide a detergent used for the above cleaning process.

In view of the above problems, the present inventors have conducted intense research and found that by forming a water phase and an oil phase in the vessel of the cleaning apparatus, the water phase having a lower content of organic substances in a detergent than the oil phase, and cleaning an object to be cleaned in thee water phase containing relatively smaller amounts of the organic substances in the detergent, the concentration of the detergent dissolved in the water phase can be made substantially at a constant level, thereby making it possible to remarkably reduce the equipment and the human powers required for the task of detergent concentration control, and thus have completed the present invention.

Specifically, the Gist of the present invention is as follows:

(1) A process for cleaning an object to be cleaned, comprising the steps of:

forming a water phase and an oil phase in a vessel of a cleaning apparatus, the water phase having a lower content of organic substances in a detergent than the oil phase, and cleaning the object in the water phase;

(2) The process described in (1) above, wherein the water phase is formed as an upper layer and the oil phase is formed as a lower layer in the vessel;

(3) The process described in (1) or (2) above, wherein the process for cleaning is carried out using the detergent capable of forming the oil phase containing not less than 50% by weight of organic substances therein, while separating away from the water phase, when the detergent or an aqueous solution of the detergent is kept standing for 30 minutes at a temperature of from 20° to 100° C.;

(4) The process described in (3) above, wherein the detergent is capable of forming the oil phase containing from 70 to 99.9% by weight of the organic substances therein, while separating away from a water phase;

(5) The process described in any one of (1) to (4) above, wherein the detergent contains one or more detergent components selected from the group consisting of nonionic surfactants; aromatic hydrocarbon compounds; and esters, ethers, alcohols, and ketones, each having an aromatic hydrocarbon group;

(6) The process described in any one of (1) to (5) above, wherein the process is carried out using the detergent containing, as a detergent component, an organic compound represented by the formula:

$$R_1X(AO)_mR_2$$

or $$R_1X(AO)_nYR_2$$

wherein $R_1$ represents a substituted or unsubstituted hydrocarbon group with 6 to 18 carbon atoms having one or more aromatic rings; $R_2$ represents a hydrogen atom or a substituted or unsubstituted hydrocarbon group with 1 to 10 carbon atoms; X represents an ether group, an ester group, or an amino group; Y represents an ether group or an ester group; (AO) represents an alkylene oxide with 2 to 4 carbon atoms; m and n each represents an average molar addition number of (AO), m being from 0 to 20 and n being from 1 to 20, the organic compound being contained in an amount of not less than 30% by weight of the organic substances in the detergent;

(7) A process for cleaning a cleaning object, comprising the steps of:

forming a water phase and an oil phase in a tank other than a cleaning vessel, the water phase having a lower content of organic substances in a detergent than the oil phase, transferring the water phase into the cleaning vessel of a cleaning apparatus from the tank, and cleaning the cleaning object in the water phase in the cleaning vessel.

(8) A detergent usable for any one of the processes described in any one of (1) to (7) above, the detergent being capable of forming a water phase and an oil phase in a vessel of a cleaning apparatus, the water phase having a lower content of organic substances in a detergent than the oil phase, when the detergent or an aqueous solution of the detergent is kept standing for 30 minutes at a temperature of from 20° to 100° C.; and (9) The detergent described in (8) above, wherein the detergent contains, as a detergent component, an organic compound represented by the formula:

$R_1X(AO)_mR_2$ or $R_1X(AO)_nYR_2$ wherein $R_1$ represents a substituted or unsubstituted hydrocarbon group with 6 to 18 carbon atoms having one or more aromatic rings; $R_2$ represents a hydrogen atom or a substituted or unsubstituted hydrocarbon group with 1 to 10 carbon atoms; X represents an ether group, an ester group, or an amino group; Y represents an ether group or an ester group; (AO) represents an alkylene oxide with 2 to 4 carbon atoms; m and n each represents an average molar addition number of (AO), m being from 0 to 20 and n being from 1 to 20, the organic compound being contained in an amount of not less than 30% by weight of the organic substances in the detergent.

According to the process of the present invention, by suitably maintaining a given detergent concentration, a high cleaning performance can be achieved, without carrying out complicated operations in the measurement of concentrations of detergent components. Also, in the case where the oil phase is formed in the lower layer, the process is free from risks, such as fire and explosion due to flashing and workplace environment pollution due to odor caused by volatile organic substances.

BRIEF DESCRIPTION OF DRAWING

The present invention will become more fully understood from the detailed description given hereinbelow and the accompanying drawing which is given by way of illustration only, and thus, are not limitative of the present invention, and wherein.

Figure 1:
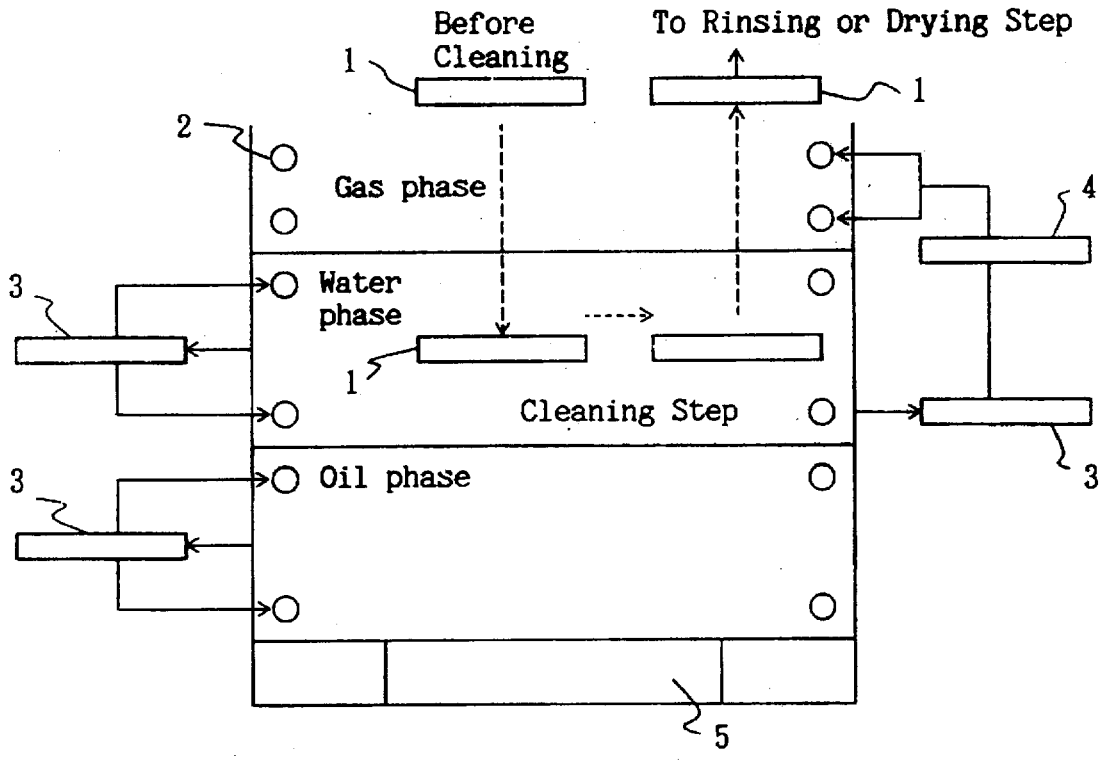
FIG. 1 is a schematic view of a cleaning vessel of a cleaning apparatus used for the cleaning process of the present invention.

The reference numerals in FIG. 1 denote the following:

1 is a work piece, 2 a jetting nozzle, 3 a pump, 4 a recycle treatment device, and 5 an ultrasonic oscillator.

DETAILED DESCRIPTION OF THE INVENTION

The cleaning process of the present invention is characterized by forming a water phase and an oil phase in a vessel of a cleaning apparatus, the water phase having a lower content of organic substances in a detergent than the oil phase, and cleaning the cleaning object in the water phase.

The detergent used in the present invention has to be able to form a water phase and an oil phase by forming the oil phase containing a given amount of organic substances therein, while separating away from the water phase, when a detergent or an aqueous solution of the detergent is kept standing for 30 minutes at a temperature of from 20° to 100° C.

Here, in order to shorten the time required for obtaining two-liquid layers consisting of the water phase and the oil phase, the proportion (separation ratio) of the organic substances transferred to the oil phase in the cleaning liquid, when a detergent or an aqueous solution of the detergent is kept standing for 30 minutes at a temperature of from 20° to 100° C., is preferably not less than 50% by weight, more preferably from 70 to 99.9% by weight, of the entire organic substances contained in the cleaning liquid. The larger the separation ratio of the organic substances, the smaller the amount of the organic substances subsequently remaining in the water phase. From the viewpoint of rinsability after the cleaning process, it is desired that a suitable amounts of the detergent components are dissolved in water. From this viewpoint, the upper limit of the separation ratio is preferably 99.9% by weight, more preferably 99% by weight.

In the process of the present invention, from the viewpoint of having good safety, securing a good workplace environment, and achieving a good cleaning performance after the formation of the water phase and the oil phase, the water phase and the oil phase are formed in the vessel by preferably providing the oil phase in a lower layer and the water phase in an upper layer. When the oil phase is formed in the upper layer, there arise such problems as risks of causing fire and generating an odor from the detergent, and the oil phase (concentrated cleaning liquid) may be carried away externally from the apparatus by adhering to the object to be cleaned. Therefore, it is desired to have a larger specific gravity of the oil phase than that of the water phase, so as to form the water phase in the upper layer portion and the oil phase in the lower layer portion in the vessel.

The solubility of the organic substances, such as surfactants, to water is determined basically by their molecular structures and temperature. Therefore, the concentration of the organic substances in water can be arbitrarily varied and controlled by suitably selecting a detergent composition, a molecular structure, and a temperature of the liquid utilizing the above properties. Also, the concentration of the organic substances in the water phase can be maintained at a Given level during the entire cleaning process, because the organic substances are dissolved in water only in an amount corresponding to saturated solubility in the water phase, while deficient amounts for saturated solubility are constantly supplied from the oil phase.

Examples of the detergent components used in the present invention include one or more compounds selected from the group consisting of nonionic surfactants; aromatic hydrocarbon compounds; and esters, ethers, alcohols, and ketones, each having an aromatic hydrocarbon group.

The nonionic surfactants include those having a cloud point of not higher than 100° C. Specific examples thereof include ether-type surfactants, such as alkyl ethers, alkylaryl ethers, and glycol ethers; alkyl ester-type surfactants; condensed-type surfactants with amines, such as polyoxyalkylene alkylamines; condensed-type surfactants with amides, such as polyoxyalkylene alkylamides; Pluronic-type or Tetronic-type surfactants obtainable by random or block condensation of polyoxyethylenes with polyoxypropylenes; and polyethyleneimine-type surfactants.

The preferred glycol ethers are polypropylene glycols, polypropylene polyethylene copolymers, and other polyalkylene glycols, each having a molar addition number of from 3 to 50, and alkyl ethers thereof and alkyl esters thereof.

Among the compounds mentioned above, a particular preference is given to a compound represented by the general formula (I):

$R_1X(AO)_mR_2$ or $R_1X(AO)_nYR_2$ from the viewpoint of having both defatting ability and rinsing property with water. Here, $R_1$ represents a substituted or unsubstituted hydrocarbon group with 6 to 18 carbon atoms having one or more aromatic rings; $R_2$ represents a hydrogen atom or a substituted or unsubstituted hydrocarbon group with 1 to 10 carbon atoms; X represents an ether group, an ester group, or an amino group; Y represents an ether group or an ester group; (AO) represents an alkylene oxide with 2 to 4 carbon atoms; m and n each represents an average molar addition number of (AO), m being 0 to 20 and n being 1 to 20.

Examples of the compounds represented by the general formula (I), a kind of a nonionic surfactant, include ethylene oxide adducts or propylene oxide adducts of phenol, styrenated phenol, benzylated phenol, cresol, benzyl alcohol, or benzylamine, and acetic acid esters or propionic acid esters thereof, and methyl ethers thereof.

Specific examples of the compounds include poly (average molar addition number P=1 to 4)oxyethylene phenyl ethers, poly(P=1 to 7)oxypropylene phenyl ethers, poly (P=1 to 2)oxyethylene benzyl ethers, poly(P=1 to 10)oxypropylene benzyl ethers, poly(P=2)oxyethylene/poly (P=4)oxypropylene phenyl ethers, and methyl ethers thereof or benzyl ethers thereof.

Since these compounds have groups which are likely to show hydrophilic properties by hydrogen bonds, such as an ether group, an ester group or a hydroxyl group, they have such properties of being easily soluble in water below a given temperature and insoluble above that temperature. The given temperature is referred to as a "cloud point." Therefore, by simply heating a detergent containing the detergent components or a cleaning liquid comprising an aqueous solution of the above detergent to a temperature above the cloud point of the detergent components, the detergent components become easily insolubilized and separate in the cleaning liquid, to thereby form the two liquid layers consisting of the water phase and the oil phase essential for the process of the present invention. Also, since the detergent components are soluble in water at temperatures below the cloud point, the portion of the cleaning liquid adhering to the object to be cleaned, such as machine parts, at the time of cleaning, can easily be removed by rinsing with water at a temperature below the cloud point, so that the rinsing process can be simplified. The cloud point of the detergent components in the present invention is normally not more than 100° C., more preferably not more than 60° C. The cloud points in the present invention are determined as a temperature at which a 5% by weight aqueous sample liquid (deionized water used) becomes cloudy.

In the detergent used in the present invention, the organic substances used as the detergent components are one or more compounds selected from the various compounds mentioned above. In this case, the detergent component represented by the general formula (I), namely $R_1X(AO)_mR_2$ or $R_1X(AO)_nYR_2$, is particularly contained in an amount of not less than 30% by weight, preferably from 50 to 100% by weight, of the organic substances in the detergent or the cleaning liquid. In cases where $R_1$ is a substituted or unsubstituted hydrocarbon group with 6 to 18 carbon atoms having one or more aromatic rings, and $R_2$ is a hydrogen atom, or a hydrocarbon group with 1 to 10 carbon atoms, excellent phase separation is achieved, and the oil phase having a higher specific gravity than that of the water phase is likely to be obtained. Particularly in cases where $R_1$ is a substituted or unsubstituted hydrocarbon group with 6 to 10 carbon atoms and $R_2$ is a hydrogen atom, or a hydrocarbon group with 1 or 2 carbon atoms, or a hydrocarbon group having an aromatic ring, further excellent effects of the present invention can be obtained. The preferred ranges for m and n are, respectively, from 0 to 20 and from 1 to 20, from the viewpoints of cleaning liquid viscosity and a cleaning performance in addition to the above features. Particularly preferred ranges for m and n are, respectively, from 0 to 4 and from 1 to 4.

Preferred examples of the compounds other than the nonionic surfactants mentioned above include compounds consisting of two or more elements selected from carbon, hydrogen, oxygen, and nitrogen, including aromatic hydrocarbon compounds and esters, ethers, alcohols, and ketones, each having an aromatic hydrocarbon group.

Specific examples of the compounds include ketones, such as dimethoxyphenylacetone and acetophenone; epoxides, such as styrene oxide, phenyl glycidyl ether, glycidol, polypropylene glycol diglycidyl ether, ethylene glycol diglycidyl ether, and neopentyl glycol diglycidyl ether; esters, such as triallyl trimellitate, tetrahydrofurfuryl acrylate, trimethylolpropane triacrylate, butanediol diacrylate, benzyl methacrylate, methyl salicylate, diethyl phthalate, dibutyl phthalate, dimethyl adipate, dimethyl maleate, tributyl citrate, tributyl trimellitate, and benzyl benzoate; alcohols, such as phenoxyethanol, butylcatechol, 1,4-butanediol, isoeugenol, cinnamic alcohol, benzyl alcohol, and dibenzylphenol; polyalkylene glycols, such as polypropylene glycols and polypropylene-polyethylene copolymers; ethers, such as dibenzyl ether; and hydroxyethylpiperazine, epichlorohydrin, anisaldehyde, phenylethyl acetal, and ester derivatives, ketone derivatives, and alkylene oxide derivatives thereof.

Also, in the detergent composition, the compounds containing halogen atoms may be used. Examples thereof include compounds obtained by replacing some or all of the hydrogen atoms with halogen atoms, the hydrogen atoms being bound to the carbon atoms of compounds, such as linear hydrocarbons, aromatic or alicyclic hydrocarbons; hydrocarbons containing aromatic or alicyclic hydrocarbon groups; alcohols derived therefrom, fatty acids derived therefrom, and amines derived therefrom; ethers, esters, ketones, and amides, each being a reaction product thereof; and ethylene oxide adducts, propylene oxide adducts, and other alkylene oxide adducts of the alcohols, the fatty acids, and the amines mentioned above.

Examples of the compounds obtained by replacing some or all of the hydrogen atoms with halogen atoms, the hydrogen atoms being bound to the carbon atoms of linear hydrocarbons, aromatic or alicyclic hydrocarbons, or hydrocarbons containing aromatic or alicyclic hydrocarbon groups, include chlorocyclohexane, dichlorobenzene, dichloroxylene, chlorotoluene, chlorinated naphthalene, bromobenzene, dibromobenzene, trichlorobenzene, fluorostyrene, fluorotoluene, 1,5-dichloropentane, 1,4-dibromobutane, and octyl bromide.

Examples of the compounds obtained by replacing some or all of the hydrogen atoms with halogen atoms, the hydrogen atoms being bound to the carbon atoms of the alcohols and fatty acids, each derived from the hydrocarbons mentioned above, and ethers, esters, and ketones, each resulting from reactions of the above alcohols and fatty acids, include chlorobenzyl alcohol, 2,3-dibromo-1-propanol, fluorophenol, chlorophenol, dichlorophenol, p-chloroacetophenone, methyl o-bromobenzoate, ethyl 2-bromoisobutyrate, decabromodiphenyl ether, and α-bromobutyric acid.

Also, compounds containing halogen atoms synthesized by subjecting an OH group of chlorobenzyl alcohol, 2,3-dibromo-1-propanol, fluorophenol, chlorophenol, dichlorophenol, or the like, to addition polymerization with ethylene oxide or propylene oxide may be added in an amount so as not to impair the properties inherently owned by the detergent of the present invention.

The detergent of the present invention has a boiling point of preferably not less than 100° C. at one atmospheric pressure, more preferably not less than 150° C. This is because volatilization of the detergent components during cleaning and drying steps should preferably be avoided in view of protection of environment and workplace atmosphere.

The term "organic substance" as used herein refers to a compound having a TOC (total organic carbon) value. Basically, TOC values are determined by the method of combustion-infrared analysis described under "Total Organic Carbon (TOC)" in "Testing Methods for Industrial Waste Water" (a method according to JIS-K0102), by, for instance, using "TOC-500" (manufactured by Shimadzu Corporation). The separation ratio of the organic substances in the cleaning liquid is a ratio of the organic substances transferred to the oil phase of the cleaning liquid, which is calculated by dividing the TOC value of the cleaning liquid in the oil phase by the sum of the TOC values of the cleaning liquids in the lower and upper layers, and multiplying the quotient by a factor of 100, to thereby express the obtained values in percentages (%).

The detergent used in the present invention may optionally contain organic or inorganic chelating agents, builders, silicone oil defoaming agents, amine rust preventives, alkanolamines, such as diethanolamine and methyldiethanolamine, alcohols, and petroleum solvents, in addition to the above-mentioned compounds, in an amount so as not to impair the essential properties of the cleaning liquid of the present invention.

The detergent of the present invention is used in the cleaning process singly or in an aqueous solution containing the detergent. In the case where the detergent is singly used, the detergent previously has a water content, and in the case where the detergent used in the aqueous solution, either no water is previously contained, or relatively small amounts of water is previously contained, if any.

In addition, the water phase and the oil phase may be formed in the cleaning vessel and then used in the cleaning process. Alternatively, the water phase and the oil phase may be formed in a vessel, such as a detergent storage tank, other than the cleaning vessel and only the water phase essential for cleaning may be supplied in the cleaning vessel used for the cleaning process.

In the present invention, the cleaning object, such as a machine or precision part, is cleaned by immersing the cleaning object for a given period of time in the water phase formed by phase separation of the cleaning liquid comprising the detergent of the present invention or an aqueous solution containing the detergent. In this case, in order to obtain a sufficient cleaning performance, the entire cleaning object, such as a machine or precision part, is contacted with the water phase. A further improved cleaning performance can be obtained when the cleaning object is sufficiently immersed in the water phase. The water phase may be a continuous or dispersed phase. From the viewpoint of achieving a good cleaning performance and maintaining good workplace environment for the cleaning process, a greater preference is given to cleaning in the continuous water phase. By cleaning the cleaning object as mentioned above, the organic substances contained in excess of the saturated solubility separate from the water phase when water is evaporated. In the case where water is supplied, organic substances required for saturated solubility are supplied from the oil phase. Thus, it is possible to maintain an appropriate level of concentration of the detergent components in the water phase.

The present invention will be explained in detail below referring to the drawing.

FIG. 1 shows a schematic view of a cleaning vessel of a cleaning apparatus used in the cleaning process of the present invention. A higher cleaning performance can be achieved, when a mechanical force or physical force, such as ultrasonication, stirring or in-liquid jetting, is applied to the cleaning liquid comprising a detergent singly or an aqueous solution of the detergent during cleaning.

In FIG. 1, an example where each of the water and oil phases is stirred by circulating each of the phases using a pump 3 is given. In view of maintaining a detergent concentration in the water phase and maintaining the workplace environment for cleaning, the mechanical force or other forces is preferably applied to an extent so as not to re-blend the lower layer with the upper layer.

From the viewpoint of cleaning efficiency, the water phase depth in the cleaning vessel is preferably set at a level such that the entire machine and precision parts are immersed. Also, the oil phase depth is preferably at a level for supplying and maintaining detergent components to the water phase, which should be present in a range so as not to impair the cleaning process. The oily or solid residual stains contaminating in the water phase are preferably removed by using various separation devices, such as filters and oil-water separators, arranged in the circulatory system, so that a higher cleaning performance can be desirably maintained. The solid residual stains in the oil phase can also be removed in the same manner as stains in the water phase.

In the present invention, the cleaning object, such as a mechanical or precision part, may be rinsed by arranging one or more outlets, normally 1 to 20 liquid jetting outlets (nozzles 2), above the surface of the water phase in the cleaning vessel, and jetting or spraying rinsing water thereto, so that the entire cleaning apparatus can be made compact. Here, the rinsing water used for this purpose may be any one of pure water and tap water. Alternatively, a circulated water of the water phase or water recycled from the water phase by such a recycle treatment device 4 shown in FIG. 1, such as an oil-water separator using activated charcoal, membrane, or such means as vaporization. Where necessary, the lower layer oil phase can be jetted from the above nozzles, while circulating the oil phase with a pump.

The cleaning vessel used in the present invention may comprise a single vessel, or two or more of cleaning vessels lined up for the same cleaning process. Also, where necessary, the cleaning vessel may be used in combination with a known conventional cleaning process. In addition, the cleaning Object may be cleaned with an "in-line" process, wherein the cleaning object is continuously cleaned while conveying the cleaning object with such devices as a belt conveyor. Alternatively, a barrel method or any of known cleaning processes are applicable for the cleaning process of the present invention.

The cleaning process and the detergent of the present invention can be used for cleaning rigid surfaces of glass, ceramic, metals, plastics, etc. The cleaning process of the present invention is especially effective for cleaning machine parts, electrical parts, electronic parts, precision parts and machine tools which are used for assembling and processing these parts. Here, examples of the precision parts include electronic parts, electrical parts, precision instrument parts, formed resin parts, optical parts, and the like. Illustrative examples of the electronic parts include printed Wiring boards for use in electronics-aided instruments such as computers and peripheral devices thereof, domestic electrical instruments, communications instruments, OA instruments, and the like; hoop materials for use in contact parts such as IC lead frames, resistors, capacitors, relays, and the like; liquid crystal displays for use in OA instruments, clocks, computers, toys, domestic electrical instruments, and the like; magnetic recording parts for use in recording/reproduction of image or sound and related parts thereof; semi-conductor materials such as silicon or ceramic wafers and the like; parts for use in electrostriction such as quarts oscillators and the like; and photoelectric transfer parts for use in CD, PD, copying instruments, optical recording instruments, and the like. Illustrative examples of the electrical parts include motor parts such as a brush, a rotor, a stator, a housing, and the like; ticket delivery parts for use in vending machines and various other instruments; and coin-checking parts for use in vending machines, cash dispensers and the like. Illustrative examples of the precision instrument parts include bearings for use in precision drivers, video recorders, and the like; and parts for use in processing such as super hard tips and the like. Illustrative examples of the formed resin parts include precision resin parts for use in cameras, cars and the like. Illustrative examples of the optical parts include lenses for use in cameras, eyeglasses, optical instruments, and the like, in addition to other related parts such as spectacle rims, clock housings, watch bands, and the like. Illustrative examples of the machine parts include gears, camshaft springs, shafts, bearings, and other parts for use in automobile engines and actuators. Illustrative examples of the electrical parts include motors, including those for use in video players, plastic products, electron guns, and shadow masks. Illustrative examples of the machine tools include jigs and tools which are used in respective steps for manufacturing, molding, processing, assembling, finishing, and the like of the precision parts described above, as well as various types of instruments and parts thereof that are used for handling of precision parts.

Although the cleaning process and the detergent used therefor of the present invention are highly useful for cleaning flux-stained printed wiring boards, crystalline liquid-stained glass substrates, and the like, the inventive cleaning process can be applied to any type of machine and precision parts as long as these parts have solid surfaces stained with various types of working oils, fluxes, and the like which may interfere the later treatments in assembling and processing steps, or with various types of oily staining substances which may deteriorate the characteristic properties of the final products. The cleaning process of the present invention exerts its characteristic effect especially when the staining substances are mainly organic oily substances, such as fats and oils, machine oils, quenching oils, cutting oils, greases, liquid crystals, rosin-based flux waxes, and the like. Further, staining substances contaminated with metal powders can be removed effectively, inorganic powders and the like, because these powders can be removed together with removal of the organic oily substances.

EXAMPLES

The present invention is hereinafter described in more detail by means of the following working examples and comparative examples, but is not limited by these examples.

Examples 1 through 8 and Comparative Examples 1 and 2

Detergents comprising the compositions shown in Table 1 were prepared. Each of the detergents was diluted with deionized water so as to provide a organic substance content of 30% by weight in the detergent liquid. Seven liters of the aqueous solution of the detergent was placed in a cleaning vessel having a ten-liter capacity and equipped with an ultrasonic oscillator and a mechanical stirrer, and the aqueous solution was kept standing for 30 minutes at a given temperature set between 20° and 100° C. (30° C. for Examples 2, 5, 6 and 7; 80° C. for Example 4; 50° C. for the other Examples).

After keeping the aqueous solution standing for thirty minutes, samples were taken from the water phase portion and the oil phase portion in the cleaning vessel. The organic substance content in the cleaning liquid was determined from the TOC value ("TOC-500" manufactured by Shimadzu Corporation), and the separation ratios were calculated therefrom.

In Examples 1 through 7, it was shown that at given temperatures between 20° and 100° C., not less than 50% by weight of the organic substances contained in the aqueous solution were separated therefrom, thereby resulting in the formation of a water phase in the upper layer and an oil phase comprising concentrated liquid of the detergent in the lower layer. Correspondingly, the organic substance odor generated from the detergent decreased markedly after phase separation.

In Example 8, it was shown that at 50° C., 92% by weight of the organic substances contained in the aqueous solution were separated therefrom. However, since it resulted in the formation of an oil phase in the upper layer and a water phase in the lower layer, the organic substance odor generated from the detergent increased markedly after phase separation.

Next, the following test materials were cleaned using the water phase of the above cleaning liquid after keeping the cleaning liquid standing for 30 minutes.

1) Test material 1: a steel test piece (10 cm×15 cm), coated (10 g/m$^2$) with a naphthenic mineral oil (40° C., 350 cst)
2) Test material 2: a glass substrate (10 cm×10 cm), coated (5 g/m$^2$) with a liquid crystal
3) Test material 3: a printed board (10 cm×15 cm), treated with a rosin flux.

Cleaning was performed at a temperature of 50° C. for 3 minutes under ultrasonication conditions. Thereafter, each of the test pieces was taken out from the cleaning vessel, transferred to a vessel other than the cleaning vessel, and ultrasonically rinsed in water at 30° C. contained in the separate vessel for 2 minutes. Subsequently, it was taken out from the vessel and dried at 80° C. for 15 minutes. The cleaning performance of the cleaning liquid, determined on the basis of the weight change of each test piece noted before and after cleaning, was expressed using the following equation:

$$\frac{(I-II)}{(I-III)} \times 100$$

wherein

I stands for the weight of the test piece before cleaning;

II stands for the weight of the test piece after cleaning; and

III stands for the weight of the untreated test piece.

The obtained values were evaluated as follows:

≧90: ◎ (excellent)

75–89: ○ (good)

60–74: Δ (fair).

<60: x (poor)

The results are shown in Table 1.

As shown in Table 1, Examples 1–8 showed good cleaning performance.

TABLE 1

| Detergent Composition & Evaluation Items | | Examples 1 | 2 | 3 | 4 | 5 |
|---|---|---|---|---|---|---|
| Detergent Components and Amounts (% by weight) | | | | | | |
| Hexyl alcohol $(EO)_2$ | | | | | | |
| Dibenzyl ether | | | | | | |
| Phenol $(EO)_3$ | | 95 | | | 25 | |
| Benzyl alcohol $(EO)_1$ | | | 60 | | | |
| Benzyl alcohol $(PO)_2$ | | | | | 30 | 70 |
| Chlorobenzyl alcohol | | | 10 | | | |
| Styrenated phenol $(EO)_4$ | | | | | 25 | |
| $(PO)_{10}$ $(EO)_4$ | | | | 65 | | |
| Phenol $(PO)_5(EO)_2$ | | | 30 | | | |
| Phenylethyl acetal | | | | 30 | | |
| Butyl alcohol $(EO)_2$ | | | | | | 30 |
| Octyl alcohol $(EO)_4$ | | | | | | |
| Paraffin (Average number of carbon atoms = 10) | | | | | 5 | |
| Dibutyl phthalate | | | | | | |
| Diethanolamine | | | | 1 | | |
| Oleyl alcohol $(EO)_{10}$ | | 5 | | | 15 | |
| Sodium dodecylbenzenesulfonate | | | | | | |
| Water | | | | | | |
| Separation | *1 | 95 | 98 | 83 | 91 | 68 |
| Ratio (%) | *2 | 95 | 97 | 82 | 91 | 68 |
| Odor*3 | Cleaning liquid after phase separation | D | D | D | D | D-C |
| Cleaning*4 Performance | Ultrasonic cleaning after standing for 30 minutes | ○-◎ | ○-◎ | ◎ | ◎ | ◎ |

| Detergent Composition & Evaluation Items | | Examples 6 | 7 | 8 | Comparative Examples 1 | 2 |
|---|---|---|---|---|---|---|
| Detergent Components and Amounts (% by weight) | | | | | | |
| Hexyl alcohol $(EO)_2$ | | | | 45 | | |
| Dibenzyl ether | | | 89 | | | |
| Phenol $(EO)_3$ | | 20 | | 20 | | |
| Benzyl alcohol $(EO)_1$ | | | 3 | | | |
| Benzyl alcohol $(PO)_2$ | | | | | | |
| Chlorobenzyl alcohol | | | | | | |
| Styrenated phenol $(EO)_4$ | | | | | | |
| $(PO)_{10}(EO)_4$ | | | | | | |
| Phenol $(PO)_5(EO)_2$ | | | | | | |
| Phenylethyl acetal | | | | | | |
| Butyl alcohol $(EO)_2$ | | | 5 | | 80 | |
| Octyl alcohol $(EO)_4$ | | 5 | | | | |
| Paraffin (Average number of carbon atoms = 10) | | | | 20 | | |
| Dibutyl phthalate | | 76 | | | | |
| Diethanolamine | | | 1 | | | |
| Oleyl alcohol $(EO)_{10}$ | | | 2 | 15 | 10 | |
| Sodium dodecylbenzenesulfonate | | | | | 10 | 20 |
| Water | | | | | | 80 |
| Separation | *1 | 90 | 87 | 92 | — | — |
| Ratio (%) | *2 | 91 | 87 | 93 | — | — |
| Odor*3 | Cleaning liquid after phase separation | D-C | D | C | C | D |
| Cleaning*4 Performance | Ultrasonic cleaning after standing for 30 minutes | ◎ | ◎ | ○ | — | — |

$(EO)_n$: Ethylene oxide adduct
$(PO)_n$: Propylene oxide adduct
n: Average molar addition number
Notes

*1: $\frac{\text{Oil phase TOC}}{\text{(Lower layer TOC + Upper layer TOC)}} \times 100$

*2: $\frac{\text{Oil phase TOC}}{\text{TOC of product subjected to water content evaporation}} \times 100$

*3: Odor of cleaning liquid: C: Medium D: Slight
*4: Cleaning performance: ◎: Excellent ○: Good In order to investigate the changes in detergent concentration due to water content evaporation in the cleaning process, each of the detergents shown in Table 1 was diluted with deionized water so as to give a concentration of 30% by weight in the detergent liquid. Seven liters of the aqueous solution of the detergent was placed in the cleaning vessel mentioned above, and the aqueous solution was heated to 80° C. to evaporate water until the amount of the cleaning liquid remaining was five liters. Thereafter, the heated cleaning liquid was vigorously mixed to give a homogenous mixture, and the mixture kept standing for 30 minutes at given temperatures set between 20° and 100° C. (30° C. for Examples 2, 5, 6 and 7; 80° C. for Example 4; 50° C. for the other Examples).

After keeping the aqueous solution standing for thirty minutes, samples were taken from the oil phase portion in the cleaning vessel. The organic substance content in the cleaning liquid was determined from the TOC value ("TOC-500" manufactured by Shimadzu Corporation), and the separation ratios were calculated therefrom. Substantially no changes in separation ratios were observed in Examples 1 to 8, retaining a given level of detergent concentration in the water phase. On the other hand, in the case of Comparative Examples 1 and 2 where the detergent was dissolved in water, phase separation was not observed, consequently resulting a large change in detergent concentration in the water phase due to water evaporation.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for cleaning an object comprising the steps of:

adding a detergent composition comprising one or more nonionic surfactants to a cleaning vessel;

separating said detergent composition comprising said one or more nonionic surfactants into a water phase layer and an oil phase layer in said cleaning vessel, wherein said water phase layer has a lower content of organic components of said detergent composition than the oil phase layer; and cleaning said object in the water phase layer.

2. The process according to claim 1, wherein the process for cleaning is carried out using a detergent composition which forms an oil phase layer containing not less than 50% by weight of said organic components therein, said organic components separating away from the water phase layer when the detergent composition or an aqueous solution of the detergent composition is kept standing for 30 minutes at a temperature of from 20° to 100° C.

3. The process according to claim 2, wherein said detergent composition forms an oil phase layer containing from 70 to 99.9% by weight of the organic components therein.

4. The process according to claim 2, wherein said process is carried out using a detergent composition containing, as a detergent component, an organic compound represented by the formula:

$$R_1X(AO)_mR_2$$

or $$R_1X(AO)_nYR_2$$

wherein $R_1$ represents a substituted or unsubstituted hydrocarbon group with 6 to 18 carbon atoms having one or more aromatic rings; $R_2$ represents a hydrogen atom or a substituted or unsubstituted hydrocarbon group with 1 to 10 carbon atoms; X represents an ether group, an ester group, or an amino group; Y represents an ether group or an ester group; (AO) represents an alkylene oxide with 2 to 4 carbon atoms; m and n each represents an average molar addition number of (AO), m being from 0 to 20 and n being from 1 to 20, the organic compound being contained in an amount of not less than 30% by weight of the organic components in the detergent composition.

5. The process according to claim 1 wherein said nonionic surfactant has a cloud point of not more than 100° C.

6. The process according to claim 1, wherein said water phase layer is above said oil phase layer in the cleaning vessel.

7. A process for cleaning an object comprising the steps of:

adding a detergent composition comprising one or more nonionic surfactants to a first vessel;

separating said detergent composition comprising said one or more nonionic surfactants into a layer of a water phase and a layer of an oil phase in said first vessel, wherein said water phase has a lower content of organic components of said detergent composition than said oil phase;

transferring the water phase to a second cleaning vessel; and cleaning said object in the water phase of said second cleaning vessel.

8. The process according to claim 7 wherein said nonionic surfactant has a cloud point of not more than 100° C.

* * * * *